United States Patent [19]

Cheng

[11] Patent Number: 4,759,519

[45] Date of Patent: Jul. 26, 1988

[54] GARBAGE COLLECTION AUXILIARY APPARATUS

[76] Inventor: Wen H. Cheng, 323, Sec. 2, An Kang Road, Hsin Tien, Taipei, Taiwan

[21] Appl. No.: 52,287

[22] Filed: May 21, 1987

[51] Int. Cl.[4] ..... B65B 67/04

[52] U.S. Cl. ..... 248/99; 248/125

[58] Field of Search ..... 248/95, 97, 98, 99, 248/100, 101, 125, 188.5, 156

[56] References Cited

U.S. PATENT DOCUMENTS

| | | | |
|---|---|---|---|
| 1,542,164 | 6/1925 | Nelson | 248/100 X |
| 2,162,113 | 6/1939 | Noffsinger | 248/100 |
| 3,916,962 | 11/1975 | Stolt | 248/101 X |
| 3,942,832 | 3/1976 | Haas, Jr. | 248/101 X |
| 3,980,409 | 9/1976 | Turner | 248/188.5 X |
| 4,023,842 | 5/1977 | Harvey | 248/99 X |
| 4,029,279 | 6/1977 | Nakatani | 248/188.5 |
| 4,079,978 | 3/1978 | McMullin | 248/118.5 X |
| 4,548,372 | 10/1985 | Lutzker | 248/99 |
| 4,616,743 | 10/1986 | Bylenga | 248/99 X |

*Primary Examiner*—Ramon O. Ramirez

[57] ABSTRACT

Frame apparatus for leaf-collecting garbage bag having a rectangular frame. One side of the rectangular frame is provided with leg means to support the apparatus in an upright standing position on the ground. The side opposite and parallel the one with the leg means is provided with an attachment means for selectively attaching a handle. The other two sides of the frame apparatus which are vertical to the ground when the apparatus is used are provided with length adjustment means for adjusting the area covered by the frame structure to accommodate different sizes of the garbage bags used. Near the four corners of the frame apparatus are provided with clip elements for attaching plastic garbage bag to the frame apparatus.

6 Claims, 5 Drawing Sheets

GARBAGE COLLECTION AUXILIARY APPARATUS

BACKGROUND OF THE INVENTION

This invention relates generally to a garbage collection auxiliary apparatus for supporting and securing a garbage collection bag to facilitate garbage collection operation.

Garden or yard care requires frequent collection and removal of fallen leaves or mown grass as well as other garbages. Plastic garbage bags are frequently used for containing the leaves, grass or garbage and then disposed away directly. Plastic garbage bags, however, are both thin and soft and thus require at least one person to hold and open the bag for another person to dump the collected leaves or grass into it.

SUMMARY OF THE INVENTION

One object of this invention is to provide a garbage collection auxiliary apparatus for supporting a plastic garbage bag in an opened status so as to facilitate the acception of garbages shoveled or dumped into the bag.

Another object of this invention is to provide a garbage collection auxiliary apparatus for supporting and securing plastic garbage bags. This apparatus has an adjustable mechanism to accommodate different sizes of garbage bags.

Still another object of this invention is to provide a garbage collection auxiliary apparatus for supporting and securing plastic garbage bags. This apparatus can further support the bag in an opened position with the opening of the bag upright on the ground.

Yet another object of this invention is to provide a garbage collection auxiliary apparatus for supporting and securing plastic garbage bags, which can be easily assembled using fewest parts.

The foregoing objects and others are accomplished by this invention by providing an apparatus of adjustable structure having a basically rectangular frame. One side of the rectangular frame is provided with leg elements to support the apparatus in an upright standing position on the ground. The side opposite and parallel to the one with the leg elements is provided with an attachment means for attaching a handle.

The other two sides of this apparatus which are vertical to the ground when the apparatus is used are provided with length adjustment means for adjusting the area covered by the rectangular frame structure to accommodate different sizes of the garbage bags used.

Near the four corners of the frame apparatus are provided with clip elements for attaching plastic garbage bag to the rectangular frame.

BRIEF DESCRIPTION OF THE DRAWINGS

Further characteristics and advantages of this invention will be described utilizing the preferred and practical embodiment together with the drawings, in which.

DETAILED DESCRIPTION OF PREFERRED EMBODIMENT

Figure 1:
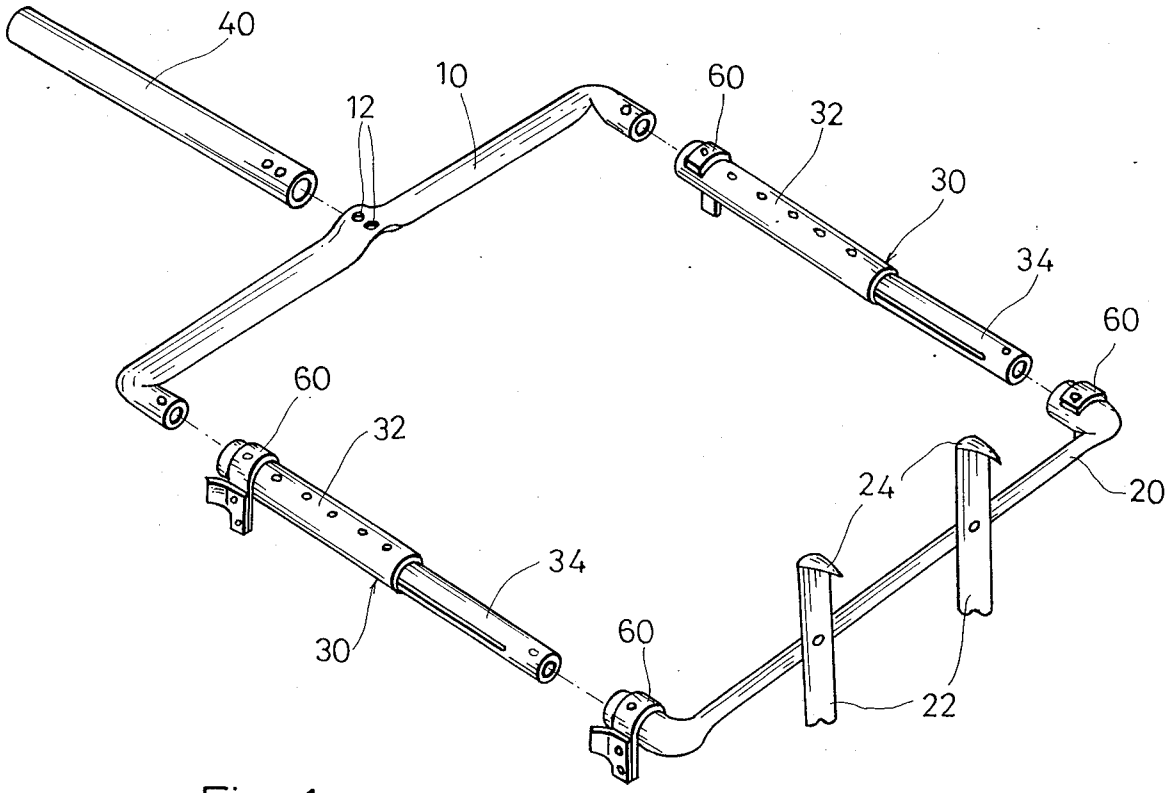
FIG. 1 is an exploded perspective view of the preferred embodiment of this invention.

In FIG. 1, there is illustrated a garbage collection auxiliary apparatus in a disassembled form according to the preferred embodiment of the present invention. The garbage collection auxiliary apparatus includes five major parts, namely a top bar member 10, a bottom bar member 20, two length-adjustable vertical bar members (or side bar members) 30, and a handle stick 40.

Figure 6:
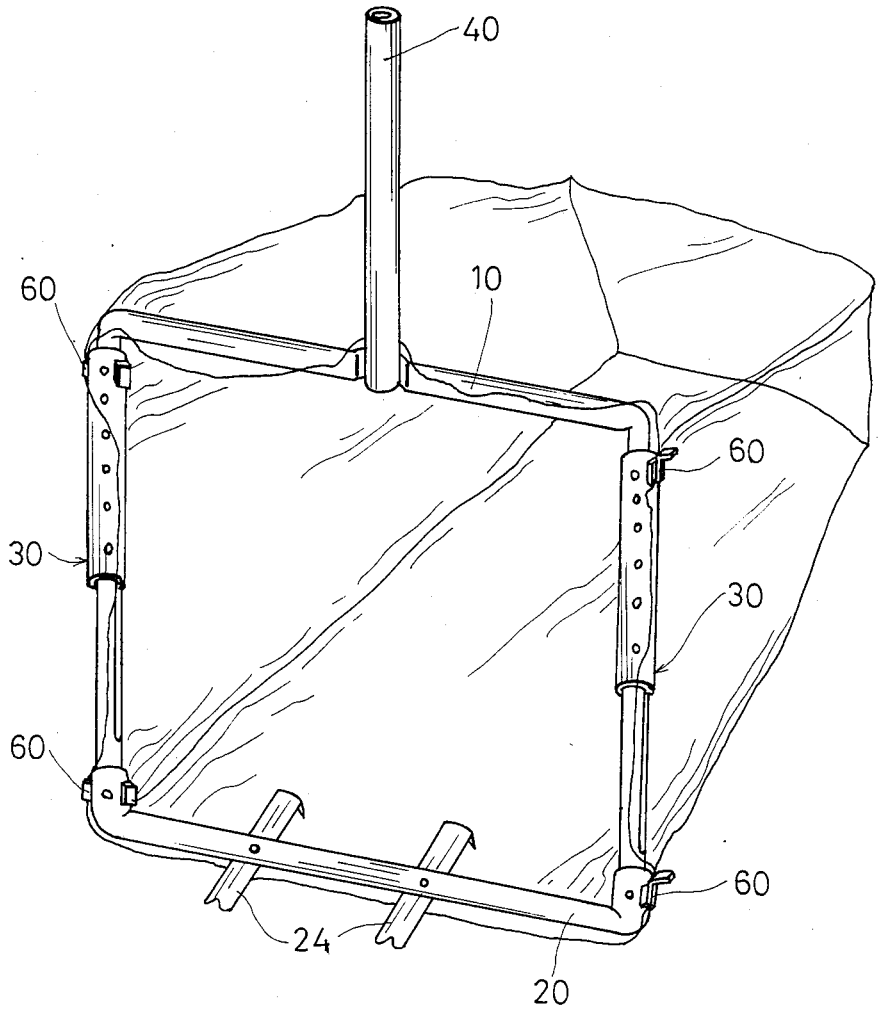
FIG. 6 is a perspective view of the garbage collection auxiliary apparatus according to the same embodiment of this invention, showing the assembled state of the whole apparatus with the garbage bag also being attached thereon.

The four bar members 10, 20 and 30 constitute a closed-loop-shaped frame, such as a rectangle frame, when the entire auxiliary apparatus is assembled for use, as shown in FIG. 6. Thus the top and bottom bar members 10 and 20 have the same length and the two side bar members 30, each of them is adjustable in length, can be adjusted to the same length.

Referring specifically to FIG. 1, the top bar member 10 is basically made of a hollow bar, or a tube, though other configurations can also be used, and is symmetrical with respect to the center line perpendicular to the longitudinal axis of the bar. Both ends of the top bar member 10 is bent 90 degrees toward the same direction. Preferably, the length of the section after the bent portion and perpendicular to the main body of the top bar member 10 is approximately 1.5 to 2 times the diameter or width of the main bar body.

Refer again to FIG. 1. At the center of the top bar member 10 is provided with a structure for optionally connecting to a handle stick 40 which can facilitate the operation of the closed-loop-shaped frame. In this embodiment, this structure is an approximately one-third to one-half surface structure of a cylindrical rim of a cylinder. The concave surface of the cylindrical rim can accommodate the exterior cylindrical surface of the handle stick 40 which can be optionally attached to the top bar member 10.

As seen in FIG. 1, the cylindrical rim structure is formed by pressing the hollow bar of the main bar body. The material of the frame is selected to be any conventional metal that can easily be pressed by conventional press work techniques.

There are provided with two holes 12 in the cylindrical rim for accepting two screws (not shown) that will secure the handle stick 40 to the top bar member 10 by threading connection.

The bottom bar member 20 in FIG. 1 shows a generally similar configuration as the top bar member 10. Preferably, the bottom bar member 20 is also made of a hollow tube. At both ends of the bottom bar member 20, the tip portions are bent toward the same direction. The length of the bottom bar member 20, excluding the bent portions, is the same as that of the top bar member 10. Preferably, the lengths of the bent portions are also the same as those of the top bar member 10.

In this described embodiment, the main bar body of the bottom bar member 20 is pressed into a substantially flat shape which has a slight curvature across the width of the main bar body. Such curvature serves to prevent the main bar body from bending along its length.

As seen in FIG. 1, the bottom bar member 20 is provided with two leg elements 22. The two leg elements 22 are located at proper positions along the length of the bottom bar member 20, for example, at the positions spacing from both ends by one-third the length of the bottom bar member 20, respectively. Where suffice, only one leg element 22 can also be employed. Of course, the only leg element 22 should be attached to approximately the center position of the bottom bar member 20.

Each leg element 22 is basically a flat long plate pivoted at its center point to the bottom of the U-shaped bottom bar member 20. If only one leg element 22 is employed, the pivot point will be near or at the center of the bottom bar element 20. If two leg elements 22 are employed, the pivot points will be respectively at the positions one-third the length from both ends of the bottom bar member 20.

Preferably, the leg element surface has a small curvature across the length of the entire leg element 22 so as to prevent the leg element 22 from bending when subjected to external pressure.

If only one leg element 22 is used, the length of the leg element 22 is preferably one-third to one half the length of the bottom bar member 20. If two leg elements 22 are used, the length of each leg element is preferably one-fifth to one-fourth the length of the bottom bar member 20.

When the entire structure is disassembled and stored, the leg elements 22 are rotated to a position so that they are parallel to the main bar body of the bottom bar member 20. When the frame structure is assembled and used, each of the leg elements 22 can be rotated to a position so that the longitudinal axis of the bottom bar member 20 is perpendicular to the longitudinal axis of the leg elements 22. Thus the bottom bar element 20 and the leg elements 22 can extend a surface that allow the entire structure of the garbage collection auxiliary apparatus of the present invention to sit upright.

At least one end of the leg element 22 is provided with a sharp toe element 24 that extends downward, opposite the direction pointed by the two bent portions of the bottom bar member 20. At least one of the two leg elements 22, if two are employed, is provided with the toe element 24. This toe element 24 is used to dig into the ground when used outdoors in the garden to prevent the entire apparatus from moving away from the user when leaves or other garbage are pushed into a plastic garbage bag secured to the garbage collection auxiliary apparatus, as will be described later.

Due to the similarity of the basic structures of the top and bottom members 10 and 20, both of which are of wide "U"shapes, the manufacturing method of the basic main bar bodies of the top and bottom bar members 10 and 20 can be the same. The top bar member 10 requires an additional press working process to make the cylindrical rim for this described embodiment, while the bottom member 20 requires the attachment of the one or two leg elements 22.

Figure 2A:
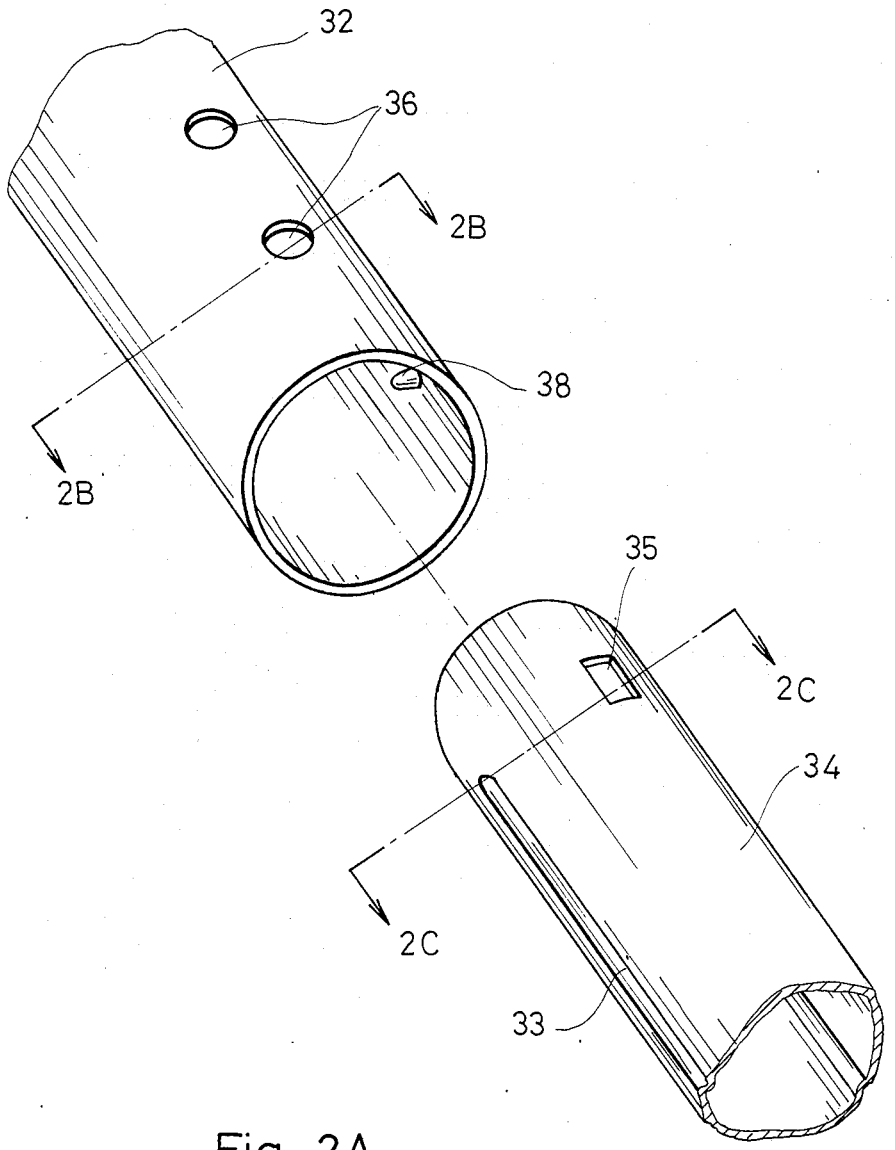
FIG. 2A is an exploded perspective view of the length-adjustable vertical bar member in the same embodiment, showing only part of a larger tube and a smaller tube that constituting the vertical bar member.

Referring now to FIG. 2A, it shows one of the two length-adjustable side or vertical bar members 30 employed in this preferred embodiment of the present invention. Each vertical bar member 30 of this embodiment comprises two hollow tubes 32 and 34 one within the other. The inner diameter of the larger tube 32 is slightly larger than the outer diameter of the smaller tube 34. The difference is the tolerance required for smooth sliding of the smaller tube 34 within the larger one 32.

As seen in FIG. 2A, the larger tube 32 is provided with two rows of through holes 36 (only one row is shown in this Figure). The two rows of holes 36 are arranged on the tube surface along the longitudinal direction of the tube. The two rows of holes 36 are arranged on the tube surface with one circumferentially opposite to the other. In other words, each row is spaced from the other by 180 degrees. The numbers of holes in the two rows are the same, and the holes in one row are aligned with the holes in the other row respectively to form a plurality pairs of aligned holes 36.

Figure 2B:
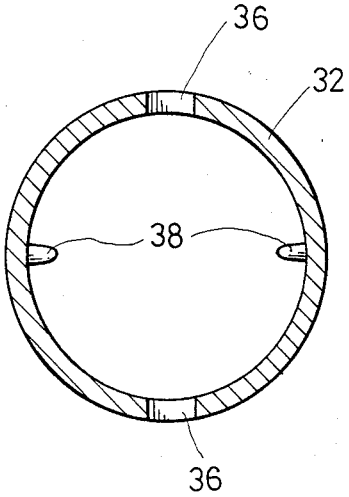
FIG. 2B is a cross-sectional view of the larger tube as shown in FIG. 2A.

At the end of the larger tube 32 where the smaller tube 34 is inserted thereinto, two guiding pins for guiding the sliding between the two telescoped tubes 32 and 34 are provided. The two pins 38 are provided on the inner surface of the larger tube 32 with one opposing the other, that is, 180 degrees spaced from each other, as shown in FIG. 2B. Each pin 38 is also spaced from the two rows of holes by 90 degrees. Thus, the two rows of holes 36 and two guiding pins 38 are disposed at the four equal-angular-distance positions on the periphery of the tube 32.

The two guiding pins 38 are attached to the larger tube 32 and extend inwardly toward the cylindrical center of the tube.

Figure 2C:
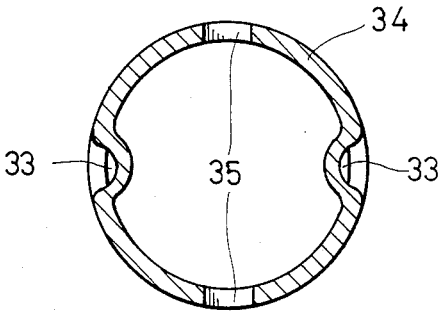
FIG. 2C is a cross-sectional view of the smaller tube as shown in FIG. 2A.

As seen in FIGS. 2A and 2C, the external surface of the smaller tube 34 is formed with two guiding slots 33 (only one guiding slot is shown in FIG. 2A) by press working. The two guiding slots 33 are formed by press working on the tube surface one opposite to the other. In other words, the two slots 33 are 180 degrees away from each other.

There are two additional through holes 35, preferably rectangular in shape, also similarly provided in the tube surface 180 degrees spaced from each other. Each guiding slot 33 is spaced from either rectangular hole by 90 degrees. Thus, the two guiding slots 33 and the two rectangular holes 35 are disposed at the four equal-angular positions along the inner periphery of the tube.

As is the case in the larger tube 32, the two rectangular holes 35 are located at the same longitudinal position along the axis of tube 34, near the end which is inserted into the larger tube 32.

When the smaller tube 34 is inserted into the larger tube 32, the two guiding pins 38 of the larger tube 32 will slide into the guiding slots 33 of the smaller tube 34 respectively. This guiding pin and slot combination will allow the two tubes to slide relative to each other, and the length of the total vertical bar member 30 can be adjusted. The longest and shortest length being decided by the positions of both ends of the guiding slots 33 of the smaller tube 34.

When the smaller tube 34 is inserted into the larger tube 32 and the guiding pins 38 slide along the slots 33, the moving paths of the two rectangular through holes 35 in the wall of the smaller tube 34, during the adjustment of the length of the vertical bar member 30, will coincide with those of the two rows of aligned through holes 36 in the wall of the larger tube 32. The two rectangular holes 35 will thus coincide with the aligned pairs of holes 36, one after the other, of the larger tube 32 during the sliding motion.

Thus, when one of the two rectangular holes 35 coincides with one hole 36 in the larger tube 32, the other rectangular hole 35 will also coincide with another hole 36 on the opposite side of the larger tube 32 and the four holes are aligned. In this instance, a spring member 50 (see FIG. 3) can fix the smaller tube 34 to the larger tube 32, and in turn determine the length of the vertical bar member 30, as shown in FIG. 4.

Figure 3:
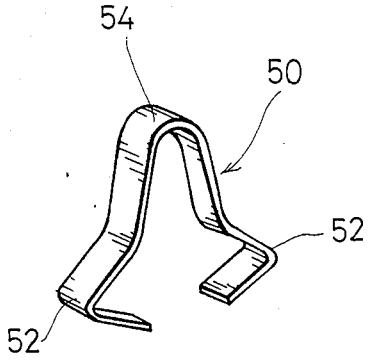
FIG. 3 is a perspective view of a spring element employed in the length-adjustable vertical bar member in same embodiment.
Figure 4:
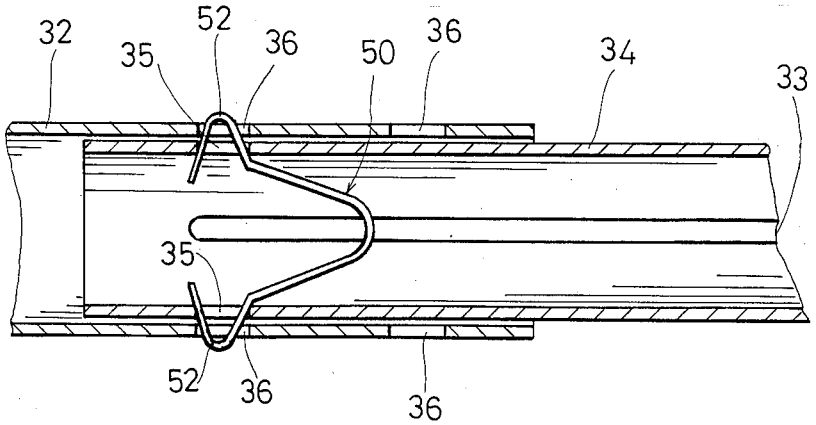
FIG. 4 is a fragmentary longitudinal sectional view of the vertical bar member, showing how the spring element illustrated in FIG. 3 is mounted within the larger and smaller tubes.

The spring member 50 employed in this embodiment is an elastic metal strip bent into a three-lobe leave configuration, as best shown in FIG. 3. Two lobes or ridge-shaped stop surfaces 52 of the leave can engage into the coinciding holes 35 and 36 of the two tubes 34 and 32, and the central lobe 54 can extend into the hollow space inside the smaller tube 34. The central lobe 54 serves to locate the spring element 50 in a stable position when the length of the vertical bar is subjected to adjustment and the two tubes slide relative to each other.

When the two tubes 32 and 34 are sliding relative to each other during the adjustment operation, the two pairs of holes 36 and 35 will not be able to coincide with each other. When a user exerts a sufficiently longitudinal force to the larger or smaller tube, the two ridge-shaped stop surfaces or side lobes 52 of the spring member 50 are pressed on their stop surfaces and move toward each other, so that the tips of the lobes 52 retract inside the inner surface of the larger tube 32, allowing the two tubes 32 and 34 to slide relative to each other. When another two pairs of holes align again the compressed two lobes 52 of the leave will immediately spring back outward and extend their leave tips outside the surface of the larger tube 32, thereby reaching another stable position, which also determines a new length of the vertical bar member 30.

With reference to FIG. 1. The smaller tube 34 of the vertical bar member 30 is connected to the bottom bar member 20 by inserting its end into the hollow space at the end of the bent portion of the bottom bar member 20. On the other hand, the larger tube 32 of the vertical bar member 30 can accept the insertion of the smaller tube diameter of the bent end of the top bar member 10.

Thus it is obvious that the entire apparatus can be made of hollow tubes of two sizes. The connections of every two successive tube bar sections are of different sizes so that one can receive the other into its hollow interior space. In this particular embodiment, the external diameters of the top and bottom bar members 10 and 20 are different.

At the sections where the top and bottom bar member 10 and 20 intersects the vertical bar member 30, namely, at the bent sections of the top and bottom bar members 10 and 20, four garbage bag clip elements 60 are attached to the intersection portions respectively by four long screws (not shown). Each long screw serves to secure two tubes and one clip elements 60 all together through a set of three aligned holes respectively in the top or bottom bar member, the clip element and the vertical bar member. The length of the screw will be and will only be sufficient to extend through the set of holes and can accept a nut.

Figure 5:
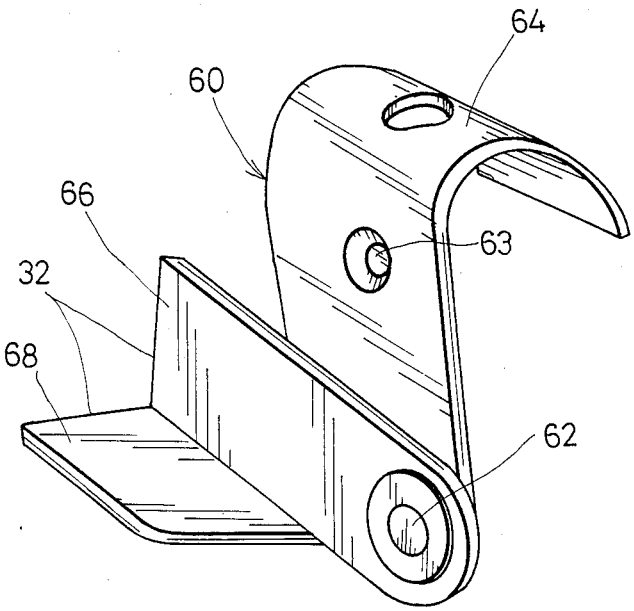
FIG. 5 is a perspective view of a clip element used for clipping a plastic garbage bag.

As shown in FIG. 5, the clip element 60 comprises a longer and a shorter sections 64 and 66 pivoted together by a rivet 62. The longer section 64 bends at the free end into half a circle. This half circle can accommodate the cylindrical body of either the bent portion of the top or bottom bar member, or the end of the vertical bar member. The shorter section 66 of the clip element 60 is provided with a ear portion 68 which is a small surface that extends from and perpendicular to the surface of the shorter section 66 itself.

On the end of the shorter section 66 opposite to the pivot 62, there is provided with a bump that can clip into a hole 63 on the longer section 64 of the clip element 60. This bump-hole pair serves to prevent the two sections 64 and 66 from rotating in relation to each other when the plastic garbage bag is clipped by the clip elements 60.

It should be noted that the length adjusting structure is not intended to be limited to the length-adjustable vertical bar member 30 described above, any other length adjusting structures can also be used, and can be achieved easily by those who are ordinarily skilled in the art.

The preferred and optimumly preferred embodiment of the present invention have been described herein and shown in the accompanying drawings to illustrate the underlying principles of the invention, however, it is to be understood that numerous modifications and ramifications, such as ones with foldable leg toe means and handle stick, can be made without departing from the spirit and scope of this invention.

What is claimed is:

1. A garbage collection auxiliary apparatus comprising:

a top bar member;

a bottom bar member;

two length-adjustable vertical bar members, the ends of each vertical bar member connected to said top and bottom bar members respectively, thereby said vertical bar members incorporating with said top and bottom bar members to form a closed-loop-shaped frame, each length-adjustable vertical bar member including a larger tube having two circumferentially opposite rows of first holes therein, a smaller tube having two circumferentially opposite second holes therein, part of said smaller tube being capable of sliding within and longitudinally along said larger tube so as to selectively make its two second holes respectively align with two circumferentially opposite first holes of said two rows of first holes, and a spring member having two ridge-shaped stop surfaces, said spring member being positioned within said smaller tube to bias its ridge-shaped stop surfaces to respectively engage into said two circumferentially opposite aligned hole pairs so that said smaller tube is fixed with respect to said larger tube, and said ridge-shaped stop surfaces being compressible into said smaller tube to permit said smaller tube sliding in relation to said larger tube when a user exerts a longitudinal force over a predetermined value on said smaller tube end, in turn, against said ridge-shaped stop surfaces of said spring element;

at least one leg element connected to said bottom bar member for supporting said closed-loop-shaped frame in an upright position; and a plurality of clip elements secured to said closed-loop-shaped frame, and adapted to clip a garbage bag thereon.

2. An apparatus as claimed in claim 1, further comprising a handle stick secured to said top bar member for facilitating the operation of said apparatus.

3. An apparatus as claimed in claim 2, wherein the ends of each length-adjustable vertical bar member are detachably connected to said top and bottom bar members respectively, said clip elements are detachably secured to said closed-loop-shaped frame, and said handle stick are detachably secured to said top bar member.

4. An apparatus as claimed in claim 1, wherein said at least one leg element includes a sharp toe for being dug into the ground to steadily support said closed-loop-shaped frame in said upright position.

5. An apparatus as claimed in claim 4, wherein said leg element is pivotally connected to said bottom bar member.

6. An apparatus as claimed in claim 1, wherein said larger tube includes two circumferentially opposite sliding pins at its interior surface, and wherein said smaller tube includes two circumferentially opposite sliding slots at its exterior surface to accept said two sliding pins therein respectively so as to prevent the relative rotation between said larger and smaller tubes and guide their relative sliding motion.

* * * * *